US008509675B2

(12) United States Patent
Seto et al.

(10) Patent No.: US 8,509,675 B2
(45) Date of Patent: Aug. 13, 2013

(54) IMAGE FORMING APPARATUS WITH ADJUSTABLE RECORDING MEDIUM HEATING

(75) Inventors: Takashi Seto, Yokohama (JP); Takashi Fujita, Yokohama (JP); Hiromitsu Takagaki, Yokohama (JP); Atsushi Nagata, Atsugi (JP); Kazuya Saito, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 516 days.

(21) Appl. No.: 12/498,716

(22) Filed: Jul. 7, 2009

(65) Prior Publication Data

US 2010/0014903 A1 Jan. 21, 2010

(30) Foreign Application Priority Data

Jul. 17, 2008 (JP) ..... 2008-185636

(51) Int. Cl.

| | |
|---|---|
| ***G03G 15/00*** | (2006.01) |
| ***G03G 15/20*** | (2006.01) |
| ***G03G 15/16*** | (2006.01) |
| ***B41J 2/01*** | (2006.01) |

(52) U.S. Cl.

USPC ..... 399/390; 399/67; 399/69; 399/307; 399/322; 347/102

(58) Field of Classification Search

USPC ..... 399/67–69, 122, 307, 320, 390, 400; 347/102

See application file for complete search history.

(56) References Cited

U.S. PATENT DOCUMENTS

| | | | | |
|---|---|---|---|---|
| 6,327,444 | B1 * | 12/2001 | Hachisuga | 399/45 |
| 6,823,167 | B1 * | 11/2004 | Gross et al. | 399/400 |
| 7,031,648 | B2 | 4/2006 | Takashi et al. | |
| 7,058,330 | B2 | 6/2006 | Nakafuji et al. | |
| 7,127,202 | B2 | 10/2006 | Fujita et al. | |
| 7,139,520 | B2 | 11/2006 | Echigo et al. | |
| 7,177,580 | B2 | 2/2007 | Nakafuji et al. | |

(Continued)

FOREIGN PATENT DOCUMENTS

| | | |
|---|---|---|
| JP | 57-163264 | 10/1982 |
| JP | 3-198080 | 8/1991 |

(Continued)

OTHER PUBLICATIONS

Office Action issued Oct. 24, 2012 in Japanese Patent Application No. 2008-185636.

*Primary Examiner* — Judy Nguyen
*Assistant Examiner* — Justin Olamit
(74) *Attorney, Agent, or Firm* — Oblon, Spivak, McClelland, Maier & Neustadt, L.L.P.

(57) ABSTRACT

An image forming apparatus includes an image bearing member to bear an electrostatic latent image on the surface thereof, a transfer-fixing member disposed adjacent to the image bar-ing member, including a transfer surface onto which the toner image is transferred from the image bearing member, a first pressure member to meet and press against the transfer-fixing member to form a nip therebetween, a heating member to heat a recording medium, provided upstream of the nip in a direction of transport of the recording medium, and a transport guide member to change a contact area of the recording medium and the heating member in accordance with a thickness or a resilience of the recording medium. When the recording medium passes the nip, the toner image is pressed and fixed on the recording medium.

20 Claims, 9 Drawing Sheets

(56) References Cited

U.S. PATENT DOCUMENTS

| | | | | |
|---|---|---|---|---|
| 7,184,069 | B2 * | 2/2007 | Yamamoto et al. | 347/179 |
| 7,215,919 | B2 * | 5/2007 | Kinouchi et al. | 399/334 |
| 7,233,762 | B2 | 6/2007 | Kunii et al. | |
| 7,254,362 | B2 | 8/2007 | Kikuchi et al. | |
| 7,269,384 | B2 | 9/2007 | Someya et al. | |
| 7,299,003 | B2 | 11/2007 | Kurotaka et al. | |
| 7,333,760 | B2 | 2/2008 | Baba et al. | |
| 7,359,666 | B2 | 4/2008 | Takashi et al. | |
| 7,369,803 | B2 | 5/2008 | Echigo et al. | |
| 7,433,641 | B2 | 10/2008 | Kikuchi et al. | |
| 7,474,870 | B2 * | 1/2009 | Kim et al. | 399/322 |
| 7,526,242 | B2 | 4/2009 | Takagaki et al. | |
| 7,551,882 | B2 | 6/2009 | Seto et al. | |
| 7,734,238 | B2 * | 6/2010 | Takahashi | 399/322 |
| 2006/0013624 | A1 | 1/2006 | Kurotaka et al. | |
| 2007/0071511 | A1 | 3/2007 | Suzuki et al. | |
| 2007/0212126 | A1 | 9/2007 | Seto et al. | |
| 2007/0212128 | A1 * | 9/2007 | Asakura et al. | 399/307 |
| 2007/0212129 | A1 * | 9/2007 | Takemoto et al. | 399/313 |
| 2007/0218386 | A1 | 9/2007 | Suzuki et al. | |
| 2008/0069606 | A1 | 3/2008 | Yamashita et al. | |
| 2008/0069610 | A1 | 3/2008 | Nakafuji et al. | |
| 2008/0138124 | A1 | 6/2008 | Kikuchi et al. | |
| 2008/0199229 | A1 | 8/2008 | Fujita et al. | |
| 2008/0219716 | A1 | 9/2008 | Takashi et al. | |
| 2008/0219717 | A1 | 9/2008 | Kayahara et al. | |
| 2008/0219718 | A1 | 9/2008 | Fujita et al. | |
| 2008/0292347 | A1 | 11/2008 | Koide et al. | |
| 2009/0003898 | A1 | 1/2009 | Kayahara et al. | |
| 2009/0016786 | A1 | 1/2009 | Suzuki et al. | |
| 2009/0074431 | A1 | 3/2009 | Aoki et al. | |
| 2009/0116880 | A1 | 5/2009 | Takagaki et al. | |

FOREIGN PATENT DOCUMENTS

| | | |
|---|---|---|
| JP | 3-63756 | 10/1991 |
| JP | 3-63757 | 10/1991 |
| JP | 11-115175 | 4/1999 |
| JP | 3042414 | 3/2000 |
| JP | 2001-337554 | 12/2001 |
| JP | 2003-91201 | 3/2003 |
| JP | 2004-145260 | 5/2004 |
| JP | 2004-191478 | 7/2004 |
| JP | 3610737 | 10/2004 |
| JP | 2005-37879 | 2/2005 |
| JP | 2005-140994 | 6/2005 |

* cited by examiner

PATCH NO. AND IMAGE DENSITY

| No. | M | Y | K |
|---|---|---|---|
| 1 | 0% | 0% | 0% |
| 2 | 20% | 20% | 0% |
| 3 | 40% | 40% | 0% |
| 4 | 60% | 60% | 0% |
| 5 | 80% | 80% | 0% |
| 6 | 100% | 100% | 0% |
| 7 | 100% | 100% | 20% |
| 8 | 100% | 100% | 40% |
| 9 | 100% | 100% | 60% |
| 10 | 100% | 100% | 80% |
| 11 | 100% | 100% | 100% |

IMAGE FORMING APPARATUS WITH ADJUSTABLE RECORDING MEDIUM HEATING

CROSS-REFERENCE TO RELATED APPLICATIONS

This patent application is based on and claims priority pursuant to 35 U.S.C. §119 from Japanese Patent Application No. 2008-185636 filed on Jul. 17, 2008 in the Japan Patent Office, the entire contents of which are hereby incorporated herein by reference.

BACKGROUND OF THE INVENTION

1. Field of the Invention

Exemplary aspects of the present invention generally relate to an image forming apparatus that includes a transfer-fixing device for electrophotography, electrostatic recording, and electrostatic printing.

2. Description of the Background Art

Conventionally, there is known an image forming apparatus in which an image is developed with toner on an image bearing member (photoreceptor) by a developing device, then transferred onto an intermediate transfer member by a primary transfer member, and subsequently transferred onto a recording medium such as paper by a secondary transfer member. Ultimately, the image on the recording medium is fixed on the recording medium by a fixing device.

In such known image forming apparatuses, transfer and fixation of the image are carried out sequentially. By contrast, other known image forming apparatuses transfer the image while fixing the image at the same time. This latter approach is known as a transfer-fixing method.

There are various types of image forming apparatuses that employ the transfer-fixing method. In one example of such an image forming apparatus, the image is secondarily transferred from the intermediate transfer member to a transfer-fixing member while the image is fixed thereon. In another example of an image forming apparatus using the transfer-fixing method, after the image is secondarily transferred and fixed onto the transfer-fixing member, the image is then transferred from the transfer-fixing member to the recording medium while being fixed thereat in a tertiary transfer process.

In general, the image forming apparatuses described above employ toner (powder consisting mainly of chargeable resin) to form the images. It is important that the toner have certain properties. For example, in terms of saving energy and reducing the size of the image forming apparatus as a whole, it is desirable that the toner be resistant to hot offset. In addition, it is desirable that the toner be fixable at a low temperature. In particular, as the temperature for fixing the image or the temperature of a transfer-fixing belt rises, unfortunately heat migrates to a photoreceptor contacting the transfer-fixing belt and to a developing portion thereof, causing deformation of the transfer-fixing belt, solidification of toner, and so forth. Therefore, toner that can be fixed at a low temperature is desirable in order to avoid these problems.

Moreover, for good image quality it is important that the toner release easily from its primary transfer member, a property called releasability. In order to enhance releasability of toner, a releasing agent, for example wax, is sometimes added to the toner. In general, however, releasing agents, including wax, have a low melting point, and for this reason exuded wax contaminates the developing member and/or an interface is formed with a resin when melting, producing turbidity and thus degrading image reproducibility. Furthermore, compatibility of the wax with the resin is poor, and as a result, as the amount of wax added increases, developability of the toner as a whole deteriorates, causing toner particles to firmly adhere to carrier particles. As a result, the toner cannot be adequately charged, or charged only unstably. For this reason, it is preferable that no wax be used as the releasing agent, or the amount of wax be reduced.

Although toner properties are important, of equal importance is the recording medium (typically paper), and more specifically, the surface properties of the recording medium. In the image forming process, for a variety of reasons degradation of imaging quality can easily occur when the image is transferred.

For example, as a recording medium onto which an image is transferred, paper is generally used. There are various types of paper. That is, there is paper having different thickness. There is also a type of paper having a very smooth surface and also there is a type of paper having a rough surface.

In particular, when the paper having a rough surface is used, the transfer member cannot accommodate the rough surface of the paper and a small gap is formed between the surface of the paper and the transfer member. As a result, abnormal electrical discharges occur in the small gap and the image is not transferred properly, forming a faded image.

In view of this, when the image forming apparatus is capable of transferring the image while fixing the image substantially at the same time, imaging quality can be prevented from degrading even if the surface of the recording medium (paper) is not smooth. This is because, when fixing the image, pressure and heat are applied at the same time, thereby softening and fusing the toner, and thus forming an elastic toner block. Accordingly, the image is properly transferred even into the small gaps on the recording medium. This is why the image forming apparatus equipped with the transfer-fixing device is suitable for producing a high-quality image.

Another advantage of image forming apparatuses that are capable of transferring the image while fixing the image substantially at the same time is that they tend to be able to accommodate not only very rough paper but also various different types of paper as well.

In general, in electrophotographic image forming methods, the toner remains on the recording medium in the form of powder until the recording medium reaches a transfer-fixing portion, at which the toner is fixed. Consequently, a sheet transport guide is provided to guide the recording medium without contacting the toner on the recording medium. As a result, the recording medium becomes unstable as it is transported in a sheet transport direction and can cause paper jams.

For this reason, in the image forming apparatus using the transfer-fixing method, the recording medium is not transported while the toner in powder form remains on the surface of the recording medium. Accordingly, the sheet transport guide can closely guide the recording medium in the sheet transport direction until the recording medium arrives at the transfer-fixing portion. As a result, various types of paper such as thin paper, thick paper, an OHP sheet, and so forth can be transported, providing flexibility in accommodation of various types of paper. It is also possible to reduce occurrence of paper jams.

Still, there are problems with the transfer-fixing process. Specifically, there are problems of energy inefficiency. In order to obtain high thermal efficiency, the temperature of the surface of the recording medium onto which the toner is fused needs to be increased. In other words, the temperature of an interface between the recording medium and the toner needs to be increased.

Conventionally, the best way to accomplish that is to press the toner against the recording sheet after the toner is adequately heated and softened. However, in order to adequately heat and soften the toner, not only the toner but also the transfer-fixing member needs to be heated.

In a case where the transfer-fixing member is relatively thick, for example, the thickness thereof is approximately 300 μm, and in particular, a tandem-type image forming method in which four image bearing members are arranged in tandem is employed, when a perimeter is long, sufficient thermal efficiency may not be secured. Furthermore, after passing through the transfer-fixing portion, the transfer-fixing member needs to be cooled before receiving a subsequent toner image despite the need for heating the transfer-fixing member to fix the previous toner image to a recording medium, thereby defeating the purpose of energy efficiency.

In another example of a related-art transfer-fixing method, the transfer-fixing member and the recording medium as well as a pressure member are heated. In this method, the transfer-fixing member is heated to a temperature equal to or less than a toner fusing temperature (the temperature at which the toner is fused), and the recording medium is heated at a temperature equal to or greater than the toner fusing temperature. With this configuration, the transfer-fixing member is not heated too much. However, both sides of the recording medium are heated, thereby defeating the purpose of energy saving. Furthermore, when duplex printing is performed, an image formed on the first printing surface melts, which can degrade the image on the second printing surface.

Moreover, even after the image is transferred and fixed on the recording medium, the heated recording medium is transported along with the transfer-fixing member. This means that the transfer-fixing member is in contact with the high-temperature recording medium for an extended period of time, reducing durability of the transfer-fixing member.

To address such a problem, there is known a method in which the recording medium is selectively heated immediately before the toner contacts the recording medium. A drawback to this approach is that the recording medium is not evenly heated. When a large number of recording media sheets is printed, undesirable toner adherence to the sheets easily occurs. Furthermore, when heating the rear surface of the recording medium that is not subjected to fixation, unnecessary energy is consumed. Thus, it is desirable to raise the temperature of only the surface of the recording medium onto which the image is transferred immediately before the image is transferred while preventing the temperature from dropping. In order to raise the temperature of only the surface of the recording medium onto which the image is transferred immediately before the image is transferred, a heating member such as a plate heating member or a high-temperature roller can be provided to heat the recording medium being transported. However, in such an approach, the temperature of the surface of the recording medium drops by the time the recording medium arrives at a nip portion where the toner image is transferred after the recording medium separates from the heating member. When relatively thick paper is used, the extent to which the temperature drops can be significant.

Finally, glossiness of a color image is also an important factor for a high-quality image. In particular, it is said that glossiness of an image on the coated paper in electrophotography is not as good as that in offset printing. Thus, similar if not the same imaging quality as that obtainable with offset printing is desired for electrophotographic image forming apparatuses.

Referring to FIG. 13, there is provided a graph showing an image density and glossiness of coated paper by electrophotography and offset printing. A horizontal axis indicates an image patch number. A vertical axis indicates glossiness (%).

The image density of Patch No. 1 is 0%, and the image density of Patch No. 2 and above increases. As can be seen in FIG. 13, glossiness in the offset printing is relatively even regardless of the image density. By contrast, in electrophotography, glossiness significantly changes depending on the image density. That is, in general, when the image density is low, the glossiness is low. When the image density is high, the glossiness is high. Thus, in a case where an image includes both a low image density portion and a high image density portion, the glossiness varies within the image so that the image as a whole looks unnatural.

The surface of plain paper is not smooth, and the paper itself is not glossy. Thus, when a low-density image (a half-tone image in which the paper surface and a toner surface coexist) is printed, low glossiness is not a significant problem. By contrast, the surface of the high-gloss coated paper itself is smooth and glossy. Thus, low glossiness in the low density portion becomes problematic.

In general, in the electrophotographic method, a toner layer forming an image on a recording medium is microscopically irregular due to adhesion between a heating-fixing member and the toner when the recording medium exits a heating-fixing nip, and cohesion of the toner during transition from a melting state to a solidified state. As a result, when the toner layer is uneven, that is, when the roughness of the surface of the toner layer is significant, the glossiness is low.

The low-density image on the coated paper includes such an irregular toner layer that reduces glossiness. By contrast, in the offset printing, the toner layer is significantly thin so that the toner layer readily conforms to the surface of the gloss coated paper and the glossiness of the low-density image does not decrease.

At the same time, with respect to temperature and heating efficiency, it is known that the thickness of the recording medium affects its temperature. When the recording medium is relatively thick, the temperature thereof drops significantly from its surface to its interior. Thus, even if a minimum amount of heat is applied to the thick recording medium, when the same heating method is applied to the thin recording medium, the surface temperature thereof increases more than an appropriate temperature. That is, more than necessary amount of heat is applied to the recording medium, thereby defeating the purpose of saving energy. Moreover, when excess energy is transmitted to the transfer-fixing member through the front surface or the rear surface, the temperature of the transfer-fixing belt increases, causing easily hot offset and so forth. Furthermore, the temperature of the rear surface of the recording medium increases excessively upon duplex printing. As a result, the toner melts again, causing degradation of the image and heat cycle.

A specific example can illustrates the general principles described above. Normally, in the image forming apparatus, a recording medium having a thickness ranging from 52.3 g/m$^2$ (60 μm) to 300 g/m$^2$ (350 μm) is transported to the transfer-fixing portion. FIG. 14 shows a result of a one-dimensional heat transfer simulation using an implicit method.

In FIG. 14, transition of the temperature on the surface of the recording medium from a nip end (at a rear end of a heating width) is calculated when a heating guide plate is formed of a 240° C. aluminum plate. The temperature is calculated when the heating width is 6 mm indicated by dotted lines and 12 mm indicated by solid lines.

As can be seen in FIG. 14, the surface temperature of the relatively thick recording medium, that is, the recording medium of 300 g/m$^2$, is lower than the surface temperature of the relatively thin recording medium, that is, the recording medium of 52.3 g/m$^2$. This is because heat of the surface layer of the thick recording medium is transmitted towards the center in the thickness direction and the back of the recording medium where the temperature is low. Consequently, the surface temperature of the thick recording medium is lower than that of the thin recording medium.

In a case where a desirable surface temperature of the recording medium of 300 g/m$^2$ is 120° C., when the heating width is 6 mm, the surface temperature of the recording medium of 52.3 g/m$^2$ is approximately 20° C. higher than that of the recording medium of 300 g/m$^2$ as indicated by an arrow A. When the heating width increases to 12 mm, the difference between the surface temperature of the recording medium of 300 g/m$^2$ and that of the recording medium of 52.3 g/m$^2$ is more than 30° C. as indicated by an arrow B.

As described above, even if a minimum amount of heat is applied to the thick recording medium, when the same heating method is applied to the thin recording medium, the surface temperature thereof increases more than an appropriate temperature. That is, more than necessary amount of heat is applied to the recording medium, thereby defeating the purpose of saving energy and leading to problems of hot offset with consequent poor imaging quality.

SUMMARY OF THE INVENTION

In view of the foregoing, in one illustrative embodiment of the present invention, an image forming apparatus includes an image bearing member, a developing device, a transfer-fixing member, a first pressure member, a heating member, and a transport guide member. The image bearing member bears an electrostatic latent image on a surface thereof. The developing device develops the electrostatic latent image formed on the image bearing member into a toner image using toner. The transfer-fixing member is disposed adjacent to the image bearing member and includes a transfer surface onto which the toner image is transferred from the image bearing member. The first pressure member meets and presses against the transfer-fixing member to form a nip therebetween. The heating member is provided upstream of the nip in a direction of transport of the recording medium to heat the recording medium. The transport guide member changes a contact area of the recording medium and the heating member in accordance with a thickness of the recording medium. When the recording medium passes the nip, the toner image is pressed and fixed thereon.

In another illustrative embodiment of the present invention, an image forming apparatus includes an image bearing member, a developing device, a transfer-fixing member, a first pressure member, a heating member, and a transport guide member. The image bearing member bears an electrostatic latent image on a surface thereof. The developing device develops the electrostatic latent image formed on the image bearing member into a toner image using toner. The transfer-fixing member is disposed adjacent to the image bearing member and includes a transfer surface onto which the toner image is transferred from the image bearing member. The first pressure member meets and presses against the transfer-fixing member to form a nip therebetween. The heating member is provided at a position upstream in a direction of transport of the recording medium relative to the nip to heat a recording medium. The transport guide member changes a contact area of the recording medium and the heating member in accordance with a resilience of the recording medium. When the recording medium passes the nip, the toner image is pressed and fixed thereon.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
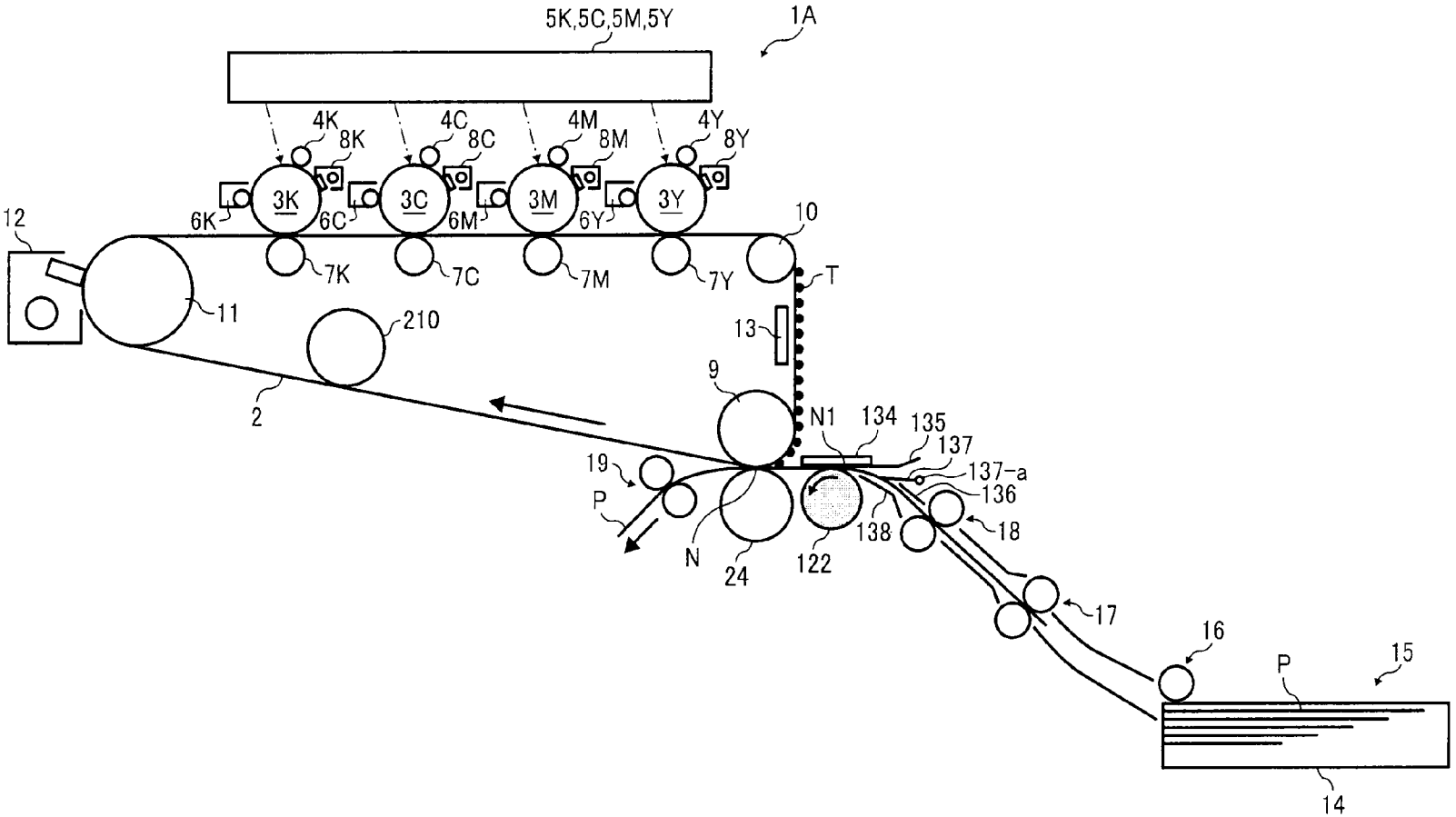
FIG. 1 is a schematic diagram illustrating an electrophotographic color copier as an example of an image forming apparatus according to an illustrative embodiment of the present invention.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and alternative example, for the sake of simplicity of drawings and descriptions, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

Referring now to FIG. 1, there is provided a side view of an internal configuration of an electrophotographic tandem-type color copier as an example of the image forming apparatus according to the illustrative embodiment.

As illustrated in FIG. 1, the image forming apparatus includes an image forming unit 1A provided substantially at the center of the image forming apparatus, a sheet feeding unit 15 provided substantially below the image forming unit 1A, and an image reading device, not illustrated, provided substantially above the image forming unit 1A. According to the illustrative embodiment, an image can be formed at a linear velocity of approximately 300 mm/s.

The image forming unit 1A includes a transfer-fixing belt 2 serving as a transfer-fixing member. The transfer-fixing belt 2 includes a transfer surface that extends horizontally. Substantially above the transfer-fixing belt 2, image forming devices including photoreceptor drums 3Y, 3M, 3C, and 3K each of which serves as an image bearing member are provided. The photoreceptor drums 3Y, 3M, 3C, and 3K bear toner images of yellow, magenta, cyan, and black, respectively, and are arranged along the transfer surface of the transfer-fixing belt 2.

An example of the transfer-fixing belt 2 includes a plurality of layers including a base material of polyimide resin of 80 μm, a silicon rubber of 160 μm, and a fluororesin of 7 μm. The silicon rubber is employed to accommodate an irregular surface of a recording medium. The fluororesin is employed on the surface of the transfer-fixing belt 2.

Alternatively, the fluororesin is not necessary if the silicon rubber layer exhibits good releasability relative to toner, paper dust, or the like.

Each of the photoreceptor drums 3Y, 3M, 3C, and 3K are rotatable in the same direction. Around each of the photoreceptor drums 3Y, 3M, 3C, and 3K, a charging device 4 that charges the photoreceptor drums 3Y, 3M, 3C, and 3K, a writing device 5 serving as an optical writing mechanism, a developing device 6, a primary transfer device 7, and a cleaning device 8 are provided. It is to be noted that reference characters Y, M, C, and K denote the colors yellow, magenta, cyan, and black, respectively. Each of the developing device 6Y, 6M, 6C, and 6K stores respective color of toner.

The transfer-fixing belt 2 is wound around a drive roller 11, and driven rollers 9 and 10, and rotates in a same direction of rotation of the photoreceptor drums 3Y, 3M, 3C, and 3K facing the photoreceptor drums 3Y, 3M, 3C, and 3K. A belt cleaning device 12 is provided opposite the drive roller 11 to clean the surface of the transfer-fixing belt 2.

The charging device 4 evenly charges the photoreceptor drum 3Y, and an electrostatic latent image is formed thereon based on image information read by the image reading device. Subsequently, the electrostatic latent image is developed as a toner image with toner of yellow by the developing device 6Y storing a yellow toner. Accordingly, a visible image (hereinafter referred to as toner image), in yellow is formed.

A predetermined bias is applied to the primary transfer device 7Y so as to primarily transfer the toner image onto the transfer-fixing belt 2. Similar to the photoreceptor drum 3Y, the toner images of the respective colors are formed relative to other photoreceptor drums 3M, 3C, and 3K. The toner images in different colors are sequentially and overlappingly transferred onto the transfer-fixing belt 2.

After the toner images are transferred, residual toner remaining on the surface of the photoreceptor drums 3 is removed by the cleaning device 8. Potential of the photoreceptor drums 3 is initialized by a charge neutralizing lamp, not illustrated, in preparation for the subsequent imaging cycle.

A description is now provided of a sheet feeding operation. As illustrated in FIG. 1, the sheet feeding unit 15 includes a sheet tray 14, a sheet feed roller 16, a pair of the sheet transport rollers 17, and a pair of the registration rollers 18. A plurality of recording media sheets P are stacked and stored in the sheet tray 14. The sheet feed roller 16 picks up and feeds the recording medium P from the top one sheet at a time to the pair of the sheet transport rollers 17.

The pair of the sheet transport rollers 17 transports the recording medium P to the pair of the registration rollers 18. The recording medium P is temporarily stopped at the pair of the registration rollers 18, and the position of the recording medium P is aligned.

Subsequently, the pair of the registration rollers 18 sends the recording medium P to a nip portion N (hereinafter referred to as a transfer nip N) where the transfer-fixing belt 2 and a pressure roller 24 meet and presses against each other, in appropriate timing, such that a predetermined position of the recording medium P in the direction of sheet transport is aligned with the front end of the toner image on the transfer-fixing belt 2.

According to the illustrative embodiment, the image forming apparatus includes a temperature regulating roller 210 that evens out the temperature of the transfer-fixing belt 2. The temperature regulating roller 210 is provided between the transfer nip N relative and a transfer portion relative to the photoreceptor drum 3K provided at the uppermost stream of the moving direction of the transfer-fixing belt 2.

The temperature regulating roller 210 is formed of a heat pipe or material having high thermal conductivity, for example, graphite, and contacts the transfer-fixing belt 2 while rotating. Alternatively, the drive roller 11 is formed of a heat pipe roller so as to serve as the temperature regulating roller 210.

In the vicinity of the driven roller 9, the pressure roller 24 is provided via the transfer-fixing belt 2, thereby forming the transfer nip N therebetween. The pressure roller 24 is a pressure member formed of metal such as aluminum and formed into a pipe shape. The surface of the pressure roller 24 is coated with a parting layer.

According to the illustrative embodiment, a preheater 13 is provided to preheat a toner image on the transfer-fixing member 2. A relatively thick recording medium, for example, paper of 300 g/m$^2$, has a heat capacity greater than that of the transfer-fixing member so that it is difficult to heat only its surface by a heating guide member 135 serving as a recording medium heating member. Thus, it is desirable to employ the preheater 13 to heat the toner image on the transfer-fixing belt 2, thereby preventing the heating guide member 135 from overheating the recording medium P.

When the recording medium P transported by the pair of the registration rollers 18, later described, contacts the heating guide member 135, the surface of the recording medium P is heated until it reaches a predetermined temperature.

In order to enable the recording medium P and the heating guide member 135 to securely contact each other, a transport roller 122 formed of urethane foam or the like is provided adjacent to the heating guide member 135 and rotates in a direction of sheet transport substantially at the same speed as the sheet transport while forming a nip width (a pressure width) of approximately 3 mm to 5 mm so that.

The heating guide member 135 is a plate member. As a heat source for the heating guide member 135, a heating element 134 that exhibits positive temperature coefficient (hereinafter referred to as PTC) is adhered to a surface of the heating guide member 135 opposite the surface that contacts the recording medium. PTC herein refers to characteristics in which when a temperature of a material increases, the material experience an increase in electrical resistance, thereby preventing electrical current from flowing, and then the temperature of the material converges to a predetermined temperature. When the heating element 134 exhibits such characteristics, it is advantageous in that a constant temperature can be maintained without dedicated temperature control.

Since the heating guide member 135 is formed of a metal plate of high thermal conductivity, thermal resistance of the heating element 134 is suppressed. Furthermore, because the heating guide member 135 slidably contacts the surface of the recording medium, the heating guide member 135 can be coated with material that reduces friction coefficient, thereby increasing durability of the heating guide member 135.

The heating element 134 is a resistive heating element. The resistance thereof increases rapidly when the heating element reaches a predetermined Curie point. However, the heating element 134 includes a self temperature control function so as to prevent the temperature of the recording medium from abnormally rising. With this configuration, safety can be assured.

The temperature of the heating guide member 135 is controlled in a range of 180° C. to 220° C. to heat the surface of the recording medium being transported. The present inventors performed experiments in which a thermocouple was attached to the rear surface of the recording medium while the temperature of the heating guide member 135 was controlled in a range of 180° C. to 220° C. It was confirmed that when 0 to 60 ms elapsed after the heating guide member 135 contacts the rear surface of the recording medium, the temperature of the rear surface of the recording medium varied within 15° C. Ricoh paper type 6200 (thickness 87 μm, 69.8 g/m$^2$) was used in this experiment.

Figure 2:
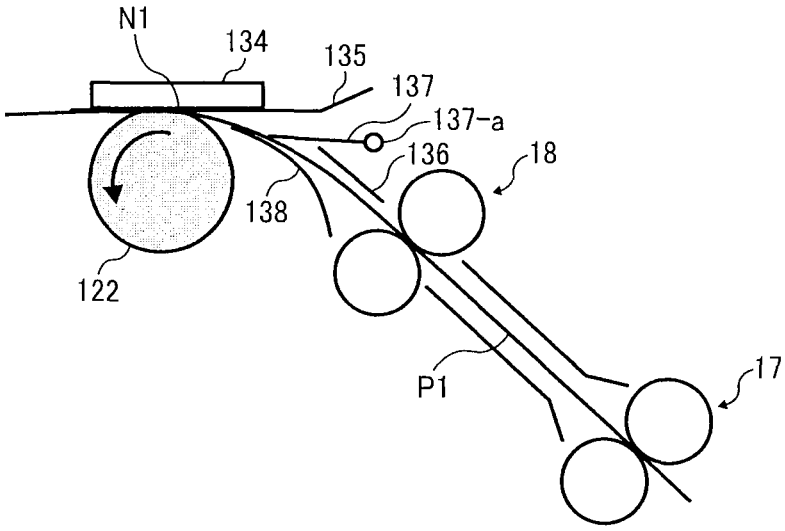
FIG. 2 is a schematic diagram conceptually illustrating a heating guide member and a recording medium when the recording medium is relatively thin according to an illustrative embodiment of the present invention.
Figure 3:
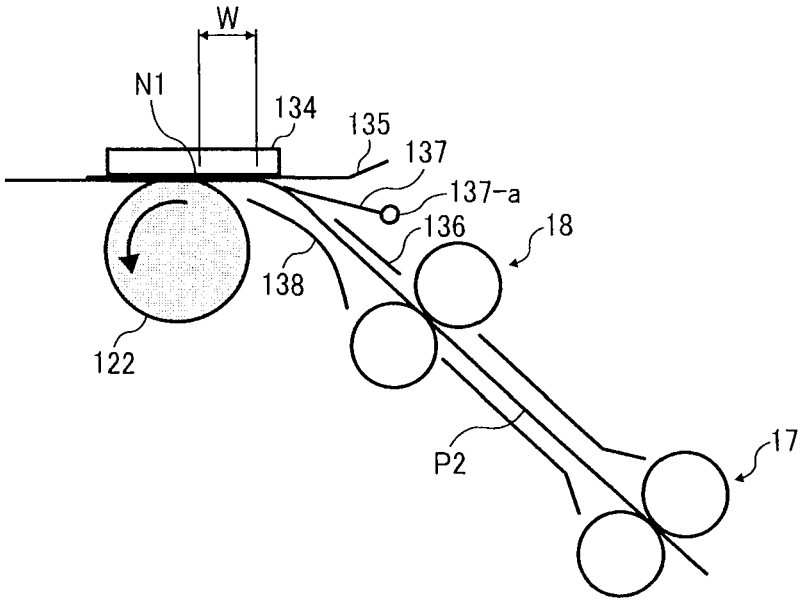
FIG. 3 is a schematic diagram conceptually illustrating the heating guide member and a recording medium when the recording medium is relatively thick according to an illustrative embodiment of the present invention.

Referring now to FIGS. 2 and 3, there are provided diagrams schematically illustrating the heating guide plate 135 contacting the recording medium being transported. FIG. 2 illustrates the heating guide plate 135 and a relatively thin recording medium being transported; whereas, FIG. 3 illustrates the heating guide plate 135 and a relatively thick recording medium being transported.

A transport guide member 137 is provided such that the transport guide member 137 blocks a passage that is an extension of the recording medium P being transported. The transport guide member 137 is rotatable about a support point 137a and pressed against a lower guide plate 138 by a spring or a leaf spring with a slight pressure, thereby contacting the lower guide plate 138.

As illustrated in FIG. 2, when a recording medium P1 having little resilience such as thin paper is transported, the transport guide member 137 guides the tip of the recording medium P1 to the vicinity of an upstream nip N1 formed between the heating guide member 135 and the transport roller 122.

By contrast, as illustrated in FIG. 3, when a relatively thick recording medium P2 of approximately 300 g/m$^2$ is transported, resilience and a force of the tip of the recording medium P2 causes the transport guide member 137 to rotate upward, thereby leading the tip of the recording medium P2 to the nip portion N1. Consequently, a portion of the recording medium P2 that contacts the heating guide member 135 increases by an amount indicated by W (hereinafter referred to as a contact width W) in FIG. 3.

The length of the transport guide member 137 (a position where the recording medium P contacts) and the position of the support point 137*a* (a center of rotation) are configured so as to satisfy the conditions described above. The slight pressure of the spring and the leaf spring, not illustrated, are also configured to change between thin paper and thick paper. In other words, depending on the thickness of paper, the recording medium contacts the transport guide member 137 at a different position. For example, when relatively thick paper is transported, the transport guide member 137 is configured to turn.

An angle formed between a moving direction of the recording medium sent out from the registration rollers 18 and the transport guide member 137 is preferably in a range of 15 to 45 degrees. A distance from a nip portion of the pair of the registration rollers 18 to a location of the transport guide member 137 where the recording medium contacts is in a range of 30 to 100 mm.

With this configuration, when the relatively thick recording medium P2 is transported, the width of the recording medium P2 that contacts the heating guide member 135 increases due to resilience of the recording medium P2, thereby automatically increasing the contact width W.

Figure 14:
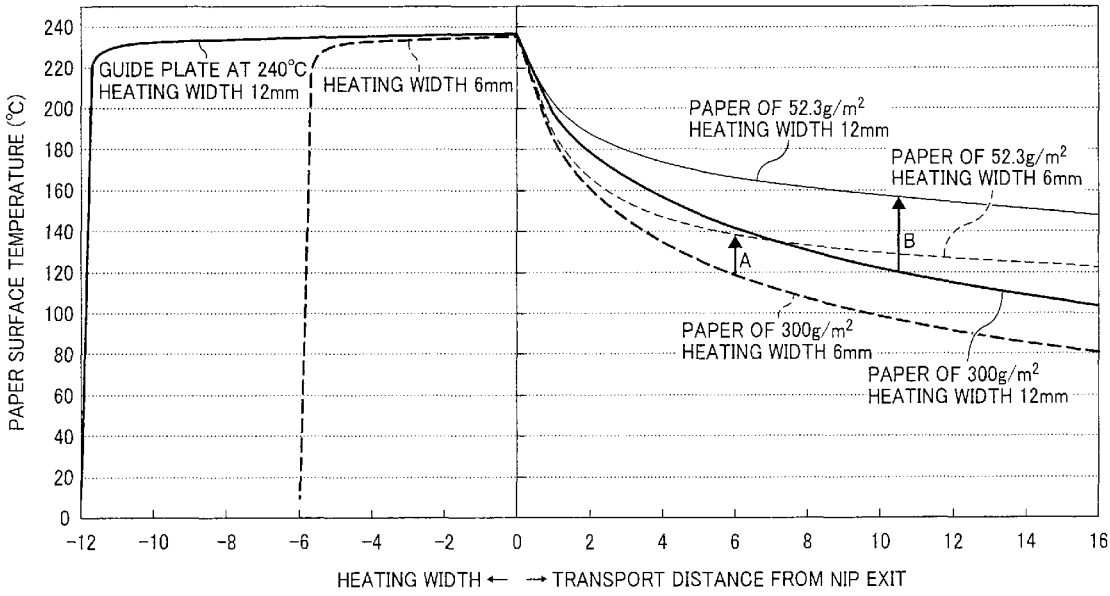
FIG. 14 is a graph showing a result of a one-dimensional heat transfer simulation using an implicit method.

For example, when the center of rotation and the position of the transport guide member 137 contacting the recording medium are configured such that the heating width of the recording medium of 52.3 g/m$^2$ is set to 6 mm depending on the pressure width (nip width) of the transport roller 122 and the contact width W of the recording medium of 300 g/m$^2$ is set to 6 mm, the surface of both the recording medium of 52.3 g/m$^2$ and the recording medium of 300 g/m$^2$ is heated at a desirable temperature of 120° C. at a place approximately 6 mm from a nip exit of the transport roller 122 as shown in FIG. 14. This is where a thin dotted line for the paper of 52.3 g/m$^2$ with a heating width of 6 mm and a bold solid line for the recording medium of 300 g/m$^2$ with a heating width of 12 mm meet and cross in FIG. 14.

The heating width herein refers to a pressure width or a so-called nip width of the transport roller 122 where the transport roller 122 and the heating guide member 135 meet and press against each other.

As described above, using the resilience of the recording medium being transported, the transport guide member 137 rotates so as to change the transport path for the recording medium. However, the present invention is not limited to the above described embodiments. Alternatively, the image forming apparatus may include a control unit including an input mechanism to which a thickness of the recording medium is input. Depending on the thickness of the recording medium, the direction of sheet transport is switched by rotating a movable guide plate similar to the transport guide member 137 via a motor or a drive transmission device.

Furthermore, the transport guide member 137 may be formed of a flexible material, for example, a Mylar Film or the like. With a slight pressure generated by resilience of the flexible material, the transport guide member 137 may contact the lower guide plate 138, thereby appreciating the same effect as that of the above described embodiments.

The material is not limited to the Mylar film. Any flexible material that can achieve the desirable effect may be used. For example, such a material includes, but is not limited to PET. The thickness thereof is preferably in a range of 100 to 300 μm. The length thereof is preferably in a range of 20 to 50 mm.

Figure 4:
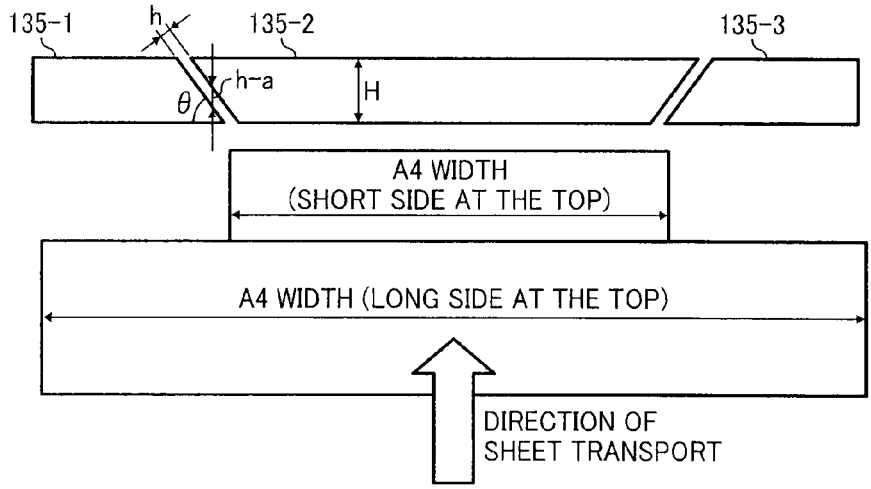
FIG. 4 is a planar view of a variation of a heating guide member according to an illustrative embodiment of the present invention.
Figure 5:
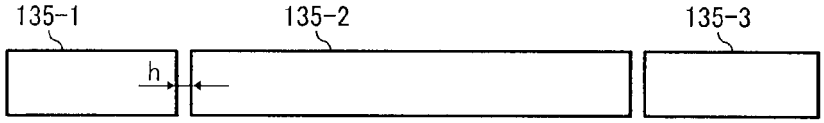
FIG. 5 is a planar view of another variation of the heating guide member according to an illustrative embodiment of the present invention.

Referring now to FIGS. 4 through 6, a description is provided of variations of the foregoing embodiments.

FIG. 4 is a diagram schematically illustrating a variation of the heating guide member 135. According to the present embodiment, the heating guide member 135 is divided into a plurality of parts.

As illustrated in FIG. 4, the heating guide member 135 includes three heating guide plates 135-1, 135-2, and 135-3. The heating guide plates 135-1, 135-2, and 135-3 are aligned, and an oblique gap h is provided between each of the heating guide plates 135-1, 135-2, and 135-3. The heating element 134 having the PTC properties is adhered to the surface of each of the heating guide plates 135-1, 135-2, and 135-3 opposite the surface contacting the recording medium.

The width of the heating guide plate 135-2 provided at the center coincides with the width of a short side of A4 sheet. The width of a long side of A4 sheet coincides with the total widths of the heating guide plates 135-1 through 135-3.

When A4 sheet is fed with the short side thereof at the top, power is supplied only to a heating element 134-2 attached on the heating guide plate 135-2. Accordingly, A4 sheet is heated only in the short-side width of A4, that is, approximately 210 mm.

By contrast, when A4 sheet with its long side at the top or A3 sheet with its short side at the top is fed, power is supplied to heating elements 134-1 and 134-3 of the heating guide plates 135-1 and 135-3, respectively, in addition to the heating element 134-2 of the heating guide plate 135-2. Accordingly, A4 sheet is heated in the long-side width thereof, that is, approximately 297 mm.

When the oblique gap h is provided, heat transmission between each of the heating guide plates 135-1 through 135-3 can be suppressed. Thus, the recording medium can be transported while being heated at minimum, that is, only in the sheet width thereof.

According to the present embodiment, the heating guide member 135 is divided into three. However, the present invention is not limited to the above-described embodiments. The heating guide member 135 can be divided into three or more to accommodate different sizes of the recording medium.

Referring now to FIG. 5, there is provided a diagram schematically illustrating a comparative example of the heating guide member 135. In FIG. 5, the gap h is provided parallel to the direction of sheet transport. In this case, the recording medium in the gap h cannot be heated so that the surface of the recording medium does not reach a necessary temperature for fixation. As a result, fixing failure occurs.

In view of this, as illustrated in FIG. 4, the gap h is oblique relative to the direction of sheet transport. In other words, the gap h is provided such that an angle θ that is not vertical is formed. With this configuration, as illustrated in FIG. 4, the ratio of the width not heated in the direction of sheet transport is expressed as follows: (h-a)/H, where H is a heating width other than the gap h. Compared with the configuration illustrated in FIG. 5, the width that is not heated can be reduced.

The heating width is slightly less than other region. However, thermal distribution is substantially even across the sheet width direction due to heat transmission in the sheet width direction from the heating area H to the transfer-fixing nip N. Accordingly, fixing failure can be prevented.

When the heating guide plates 135-1 through 135-3 are separately held, it is difficult to reliably hold, especially, the heating guide plate 135-2 provided at the center while securing its stiffness, because the heating guide plate 135-2 is relatively far away from the side panels of the apparatus main body. In view of this, it is preferable that the heating guide plates 135-1 through 135-3 are held on a same stay member.

Figure 6A:
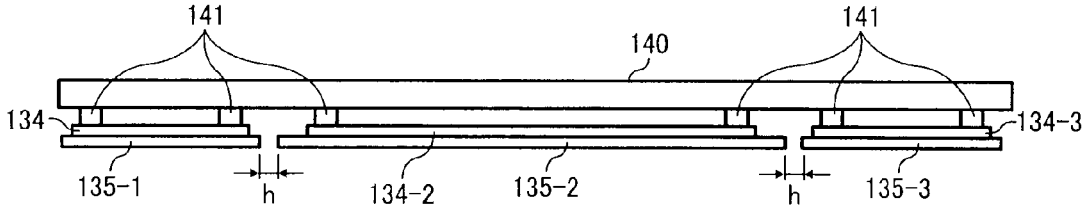
FIG. 6A is a side view of the heating guide member integrally held by a stay member according to an illustrative embodiment of the present invention.
Figure 6B:
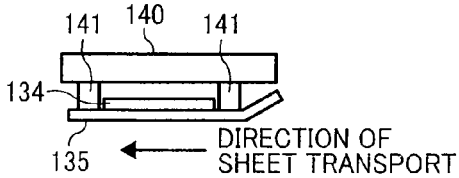
FIG. 6B is a cross-sectional view of FIG. 6A.

Referring now to FIGS. 6A and 6B, a description is provided of a stay member 140 that integrally holds the heating guide plates 135-1, 135-2, and 135-3 via support members (spacers) 141. FIG. 6A is a side view of the stay member 140 with the support members (spacers) 141. FIG. 6B is a cross-sectional view of FIG. 6A.

As illustrated in FIGS. 6A and 6B, the support members 141 formed of an insulating material, for example, a heat resistant resin, are provided between the stay member 140 and the heating elements 134-1 through 134-3. Accordingly, the heating guide plates 135-1 through 135-3 can be integrally held compact while securing stiffness thereof and suppressing heat conduction between the heating guide plates 135-1 through 135-3.

Figure 7:
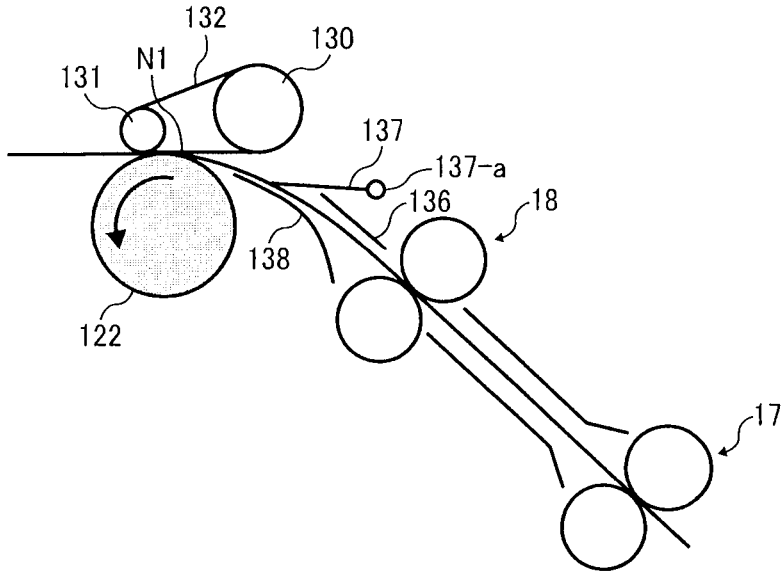
FIG. 7 is a side view of another variation of the heating guide member according to an illustrative embodiment of the present invention.

Referring now to FIG. 7, there is provided a side view of a variation of the foregoing embodiment. In FIG. 7, a heating guide member for heating includes an endless belt that is wound around and stretched between a plurality of rollers including a heat source.

As illustrated in FIG. 7, the heating guide member includes an SUS belt 132 made of metal, a high-temperature metal roller 130, and a small roller 131. In order to secure close contact between the recording medium and the SUS belt 132, a pressure member such as a roller or a leaf spring can be provided to press from the rear surface of the recording medium.

With this configuration, the recording medium and the heating guide member move at the same speed so that the recording medium does not slidably contact the heating portion. Thus, abrasion does not occur, and the recording medium can be reliably transported while being heated.

Figure 8:
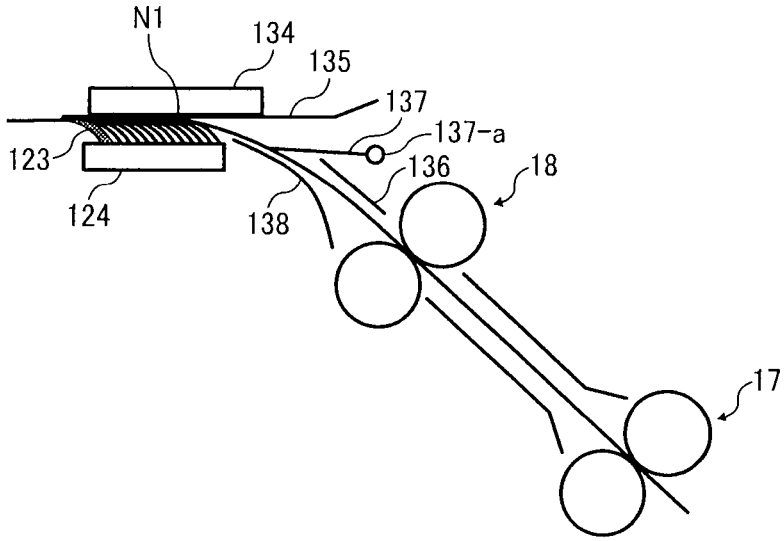
FIG. 8 is a side view of a contact condition between a pressure member and the recording medium according to an illustrative embodiment of the present invention.

Referring now to FIG. 8, there is provided a side view of a variation of the foregoing embodiment. In FIG. 8, a pressure member is provided opposite the heating guide member, and a contact condition between the pressure member and the recording medium is point contact or line contact.

In FIG. 8, the heating guide member includes the heating element 134 with the PTC property serving as the heat source. Furthermore, a pressure member 124 is provided to press the recording medium from the bottom, thereby heating the surface of the recording medium. Fibers are implanted on the pressure member 124. As the fibers of the pressure member 124, polyimide fibers can be used, for example. In order to prevent the fibers of the pressure member 124 to undesirably roll, a prevention member 123 is provided to prevent the fibers from rolling.

With this configuration, the heating area can be made relatively thin so that the recording medium can be heated until immediately before the transfer-fixing nip N while being transported, reducing, if not preventing entirely temperature drop due to idle running. Furthermore, a transport drive device is not necessary, thereby simplifying a configuration of the heating portion.

Next, a description is provided of glossiness that is a part of a parameter for high imaging quality of a color image. Conventionally, in a related art color image forming apparatus, in order to obtain sufficient glossiness, an amount of heat that is approximately 1.5 times greater than that of a monochrome image forming apparatus is applied in consideration of decrease in the temperature due to the recording medium.

A drawback of this configuration is that the recording medium may be heated excessively, and adhesion of toner to the recording medium becomes more than necessary.

By contrast, according to the illustrative embodiment, the temperature that is required to obtain sufficient glossiness can be set independently, thereby enabling the temperature of the transfer-fixing belt 2 (the fixing temperature) to be set low. Furthermore, the recording medium can be heated immediately before the transfer-fixing nip N, thereby preventing the recording medium to be heated excessively. The adhesion of the toner to the recording medium does not increase more than necessary.

According to the illustrative embodiment, heat is prevented from transferring to the intermediate transfer member, thereby enhancing durability thereof. Furthermore, the temperature of the transfer-fixing member is reduced, suppressing thermal degradation of the intermediate transfer member.

A description is now provided of thermal properties of toner associated with fixation (fixation quality). In particular, it is known that a softening temperature and a temperature at which the toner starts to flow (hereinafter referred to as a flow start temperature) relate to fixation.

The softening temperature and the flow start temperature can be measured using a flow tester. The flow tester is a tubulus rheometer that measures viscosity resistance when a fused material, i.e. toner passes through a tube.

First, a test sample (toner) is filled in a cylinder which is heated so as to melt the test sample. A constant pressure is applied thereto from the top by a piston, pushing out the fused toner through a die with a small hole. Accordingly, fluidity or the melt viscosity of the toner can be obtained from a flow rate ($cm^3/s$).

As the flow tester, a Shimadzu Flow Tester CFT-500 D is used, for example. The flow curve of the flow tester is shown in FIGS. 9A and 9B from which each temperature can be read.

Figure 9A:
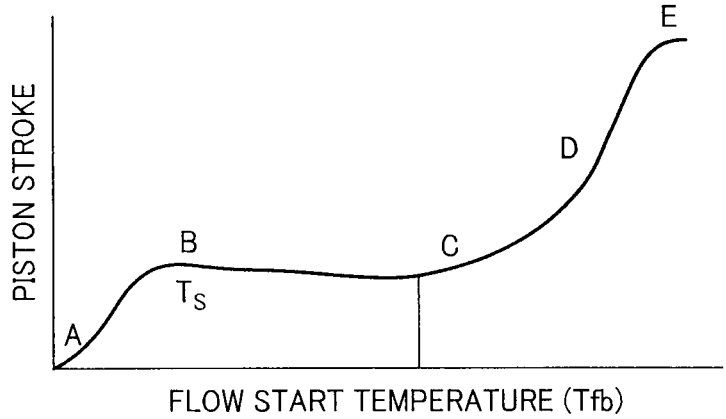
FIGS. 9A and 9B are flow curves obtained by using a flow tester according to an illustrative embodiment of the present invention.

In FIG. 9A, B indicates the softening temperature Ts at which the toner changes from a solid state to a transition state. C indicates the flow start temperature Tfb at which the toner starts to flow.

Figure 9B:
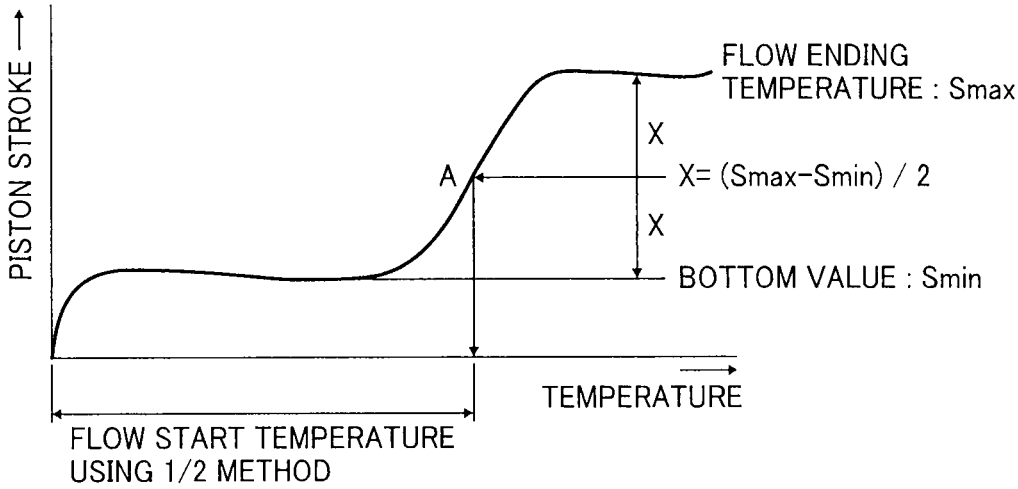

The flow start temperature of "½ method temperature" in FIG. 9B is a temperature obtained such that a difference between a flow ending point Smax and a lowest value Smin is obtained (X=(Smax−Smin)/2), and X and Smin are added (indicated as A). In the present embodiment, measurements were performed under the following conditions:

Load: 5 kgf/cm2,

Heating rate: 3.0° C./min,

Die bore diameter: 1.00 mm, and

Die length: 10.0 mm.

According to the illustrative embodiment, when the temperature of the belt is lower than the flow start temperature Tfb that is the thermal property of the toner and the temperature of the recording medium is higher than the belt temperature, hot offset can be prevented because of a difference in viscoelasticity of the toner at the recording sheet side and the toner at the belt side. That is, when the temperature of the toner layer at the recording medium side is higher than the temperature of the toner layer at the belt side, adhesion between the recording medium and the toner is substantially higher than adhesion between the belt and the toner. Accordingly, separability of the toner from the belt is enhanced while the toner adheres to the recording medium, preventing hot offset on the belt and thus being able to obtain a high quality image.

The "hot offset" generally refers to an undesirable phenomenon in which some fused toner is adhered to the surface of a heating member, and re-transferred onto a recording medium or the following sheet of the recording material.

Because hot offset is reduced, if not prevented entirely, an amount of wax that is generally added to the toner to enhance separability can be reduced or eliminated entirely. If the wax is reduced or eliminated entirely, reproduction of color, developability, and charging ability can be enhanced.

Furthermore, when the temperature of the belt is relatively low, the belt can be cooled off easily. Consequently, undesirable heating of the photoreceptor drum can be prevented, and problems such as image failure due to heat migrating to the developing portion and solidification of toner can be prevented.

The present inventor performed experiments in which toner offset was observed using a high-speed video camera. In the experiment, the high-speed video camera capable of taking 40,000 frames per second was used so as to confirm the toner offset in a micrometer scale. As a probe, a borescope of an optical magnification of 400 times with a long focal length was used. Accordingly, the recording medium getting out of the fixing nip and the toner that was offset were observed at a magnification of 400 times on a screen.

First, the toner offset was observed using a generally-known fixing device. For a fixing roller/pressure roller, a silicone rubber roller covered with a PFA tube was used. In this experiment, it was observed that the toner was stretched like a rubber between the fixing roller and the recording medium. The thready rubber-like toner was cut in the vicinity of the fixing roller, separating into the fixing roller and toward the recording medium. In the generally-known fixing device, the toner becomes thready substantially at the end of the fixing nip.

By contrast, when transfer and fixing were carried out while the temperature of both the recording medium and the toner was regulated, it was confirmed that stretch of toner scarcely occurred. This indicates that offset prevention, that is, separability, is good in the transfer-fixing device of the illustrative embodiments of the present invention.

A correlation of adherence between the fixing member and the toner (F1), internal cohesion of the toner (F2), and adherence between the toner and the recording medium (F3) cause the offset phenomenon. When F1 is the greatest, the offset occurs. In order to suppress the offset, F1 needs to be small. In normal fixing, in order to reduce F1, application of oil to the fixing member, adding wax to the toner, and stress caused by roller distortion are employed.

By contrast, in the transfer-fixing device in which the temperature of the toner as well as the recording medium is controlled according to the illustrative embodiment, separability is enhanced without application of oil or the like.

Normally, during fixation, heat is applied to toner only from the fixing member. Therefore, the temperature gradient of the toner layer at the fixing roller side is significantly greater than that at the recording medium side.

By contrast, according to the illustrative embodiment, heat equal to or less than the toner fuse temperature of toner is applied from the recording medium side to the fixing member side so that the temperature gradient of the toner layer at the fixing member side is less than the recording medium side, thereby making the value F1 small.

Figure 10:
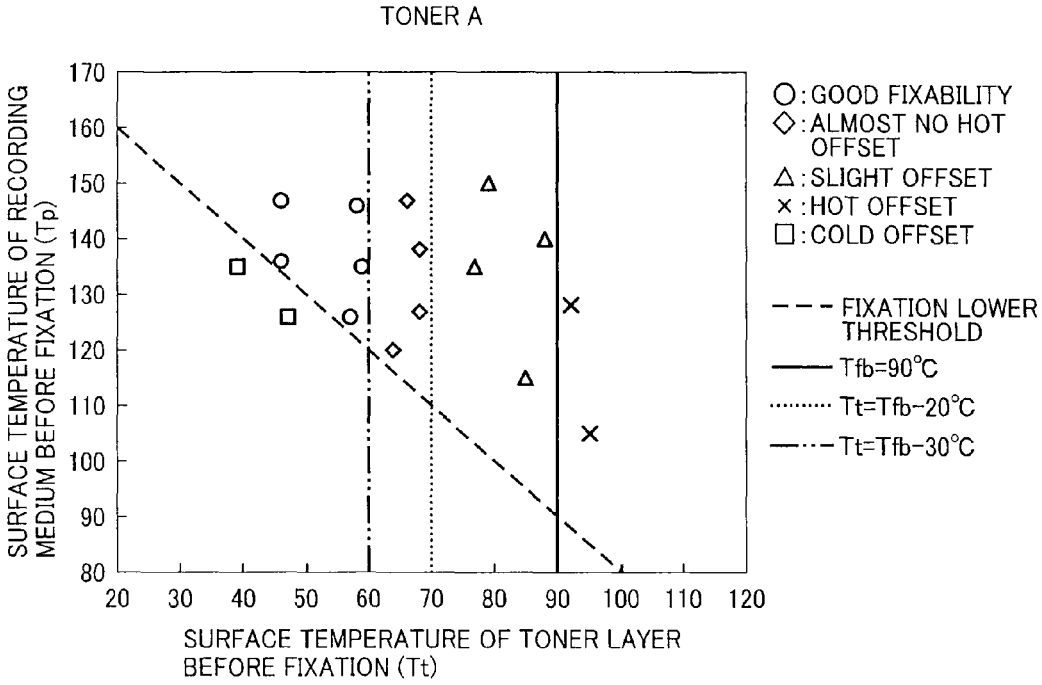
FIG. 10 is a graph showing an image fixability using toner when a flow start temperature thereof is 90° C. according to an illustrative embodiment of the present invention.
Figure 11:
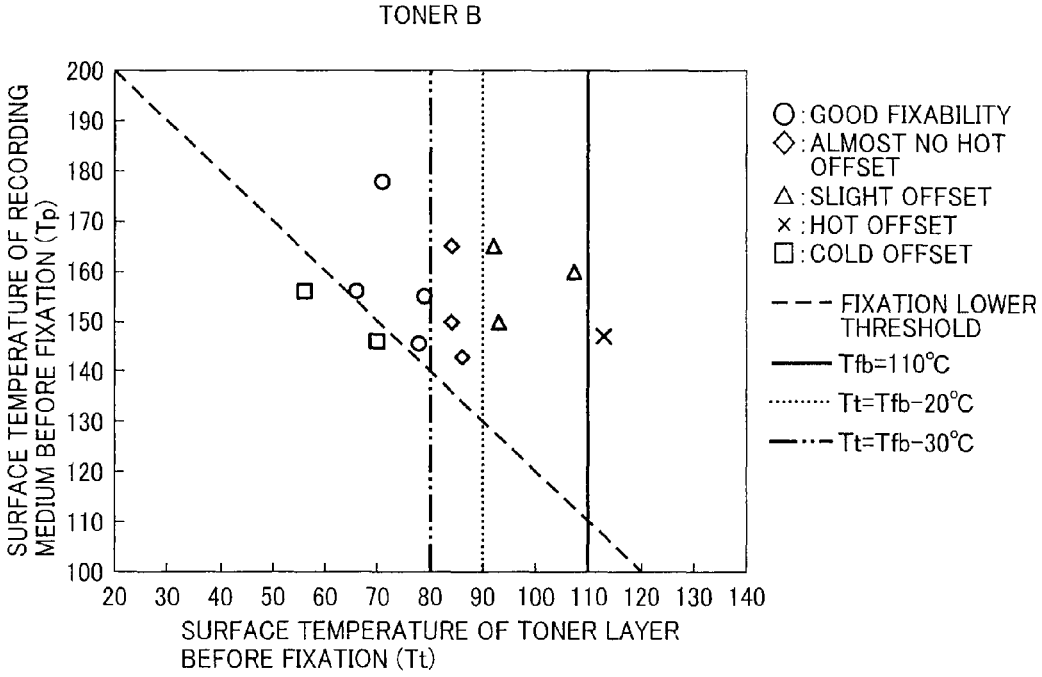
FIG. 11 is a graph showing the image fixability using toner, when the flow start temperature thereof is 110° C. according to an illustrative embodiment of the present invention.

Referring now to FIGS. 10 and 11, a description is provided of fixability according to the illustrative embodiment. FIG. 10 is a graph showing fixability when the toner flow start temperature is 90° C. (Toner A). FIG. 11 is a graph showing fixability when the toner flow start temperature is 110° C. (Toner B). In FIGS. 10 and 11, coated paper (Casablanca X of Coated paper manufactured by OJI PAPER Co., Ltd., Paper weight of 100 g/m$^2$) was used, a nip time was 50 ms, and a surface pressure was 2 kgf/cm$^2$.

In FIGS. 10 and 11, Tt is a surface temperature of the toner layer before fixation immediately before arriving at the transfer-fixing nip N. Tt is detected and controlled by a contactless temperature sensor. A belt surface temperature of the transfer-fixing belt and the temperature of the toner layer is substantially the same.

Tp is a surface temperature of the recording medium before fixation immediately before arriving at the transfer-fixing nip N. Tp is detected and controlled by a contact-type temperature sensor or the contactless temperature sensor.

An abrasion test was performed to find a lower temperature threshold of good fixability. In FIGS. 10 and 11, an upper area beyond a fixation lower threshold line indicates good fixability. The lower threshold temperature of fixation is determined based on the nip time, the type of paper, a surface pressure, and the toner.

Tfb is the toner flow start temperature. The first condition indicated by $(Tt+Tp)/2>Tfb$ defines the fixation lower threshold (no cold offset). That is, an average of heat applied from the belt to toner and from the recording medium to toner is obtained and configured greater than the toner flow start temperature. The first condition includes an additional condition, $Tt<Tfb$.

The left side from a vertical line of Tfb indicates a range of $Tt<Tfb$. Furthermore, the left side beyond a vertical line of $Tt=Tfb-20°$ C. indicates a range of $Tt<Tfb-20°$ C., which is the second condition.

The left side from a vertical line of $Tt=Tfb-30°$ C. indicates a range of $Tt<Tfb-30°$ C., which is the third condition.

In FIG. 10, when the temperature of the toner layer before fixation (Tt) is equal to or greater than the fixation lower threshold temperature and greater than the toner flow start temperature (Tfb), hot offset occurred, causing an image defect. In other words, hot offset occurs in a range of $Tfb<Tt$, even if the temperature of the toner layer before fixation is greater than or equal to the fixation lower threshold temperature.

Similarly, as shown in FIG. 11, even if the toner flow start temperature Tfb was different from that shown in FIG. 10, hot offset occurred when the temperature of the toner layer before fixation (Tt) is equal to or greater than the fixation lower threshold temperature in a range of $Tfb<Tt$, causing an image defect.

To address such a difficulty, when the temperature is controlled to satisfy the first condition $(Tt+Tp)/2>Tfb$ and fall in a range of $Tt<Tfb$, a desirable image without offset can be obtained. Furthermore, when the second condition ($Tfb-Tt\geqq 20°$ C.) is satisfied, hot offset is further reduced. Still further, when the third condition ($Tfb-Tt\geqq 30°$ C.) is satisfied, the hot offset scarcely occurs.

The "hot offset" herein refers to toner remaining on the belt after transfer fixation. When hot offset scarcely occurs, producing a good image, a slight amount of toner remains, but the toner can be easily removed by the belt cleaning device 12. When hot offset does not occur at all, this means that a transfer ratio is 100%.

Although not illustrated, when the toner flow start temperature was 82° C., 101° C., and 118° C., the same results were obtained. That is, when the first condition was satisfied, a good image was obtained.

With regards to an upper limit of the temperature of paper, it is preferable that the temperature be equal to or less than 200° C. for safety purpose.

When the condition $Tb<Ts$ is satisfied, image degradation on a rear surface (first surface) can be prevented upon duplex printing. That is, when the temperature of the pressure member 24 forming the transfer-fixing nip with the transfer-fixing belt 2 is equal to or less than the toner softening temperature, the image degradation on a rear surface (first surface) can be prevented upon duplex printing.

Conventionally, when an image is formed on one surface and a second image is formed on the other side of the recording medium, there is a difference in glossiness between the two surfaces. By contrast, according to the illustrative embodiments, a good image can be obtained without image degradation upon duplex printing.

Figure 12:
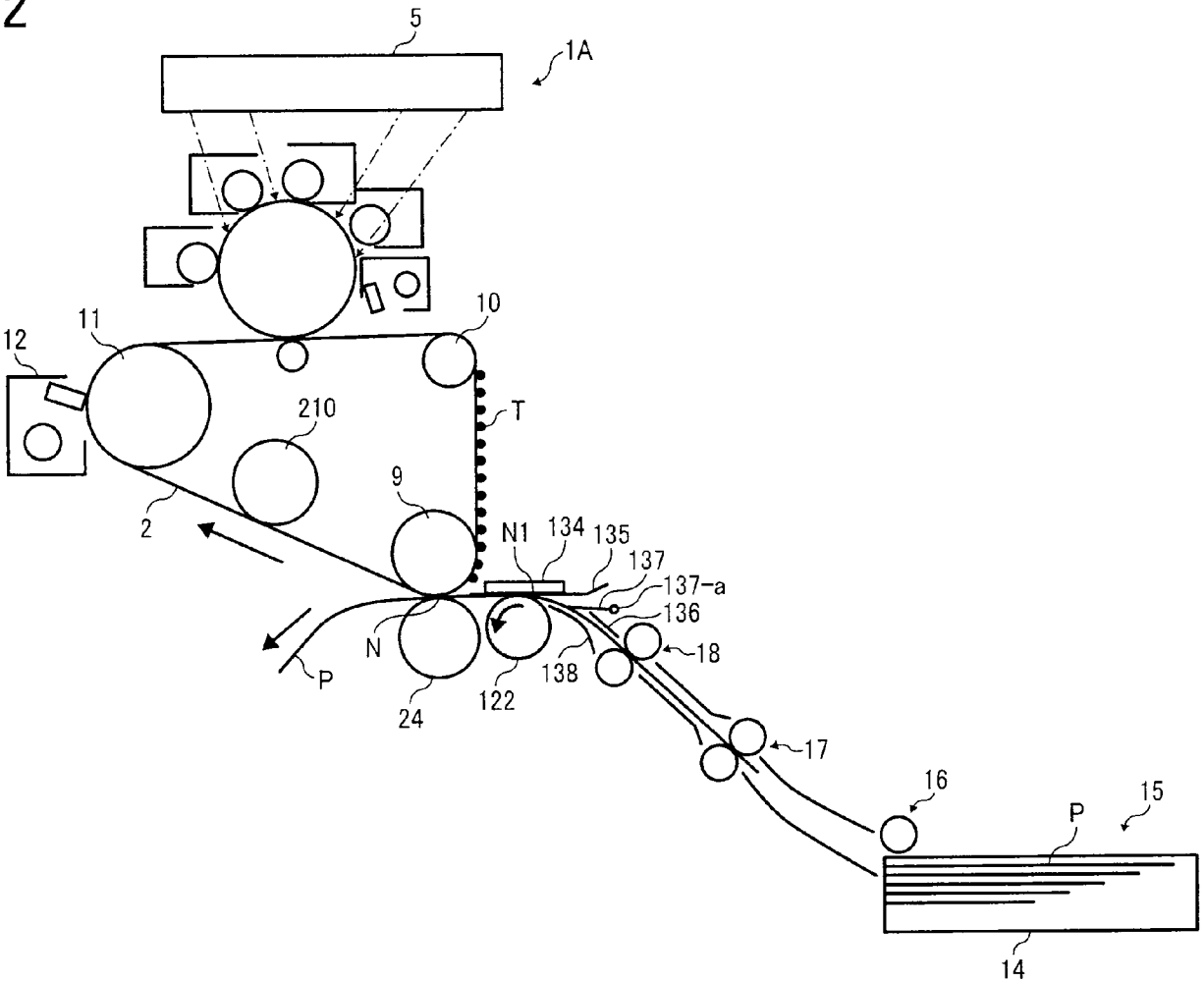
FIG. 12 is a side view of a color image forming apparatus using a single photoreceptor on which a plurality of toner images is formed according to an illustrative embodiment of the present invention.
Figure 13:
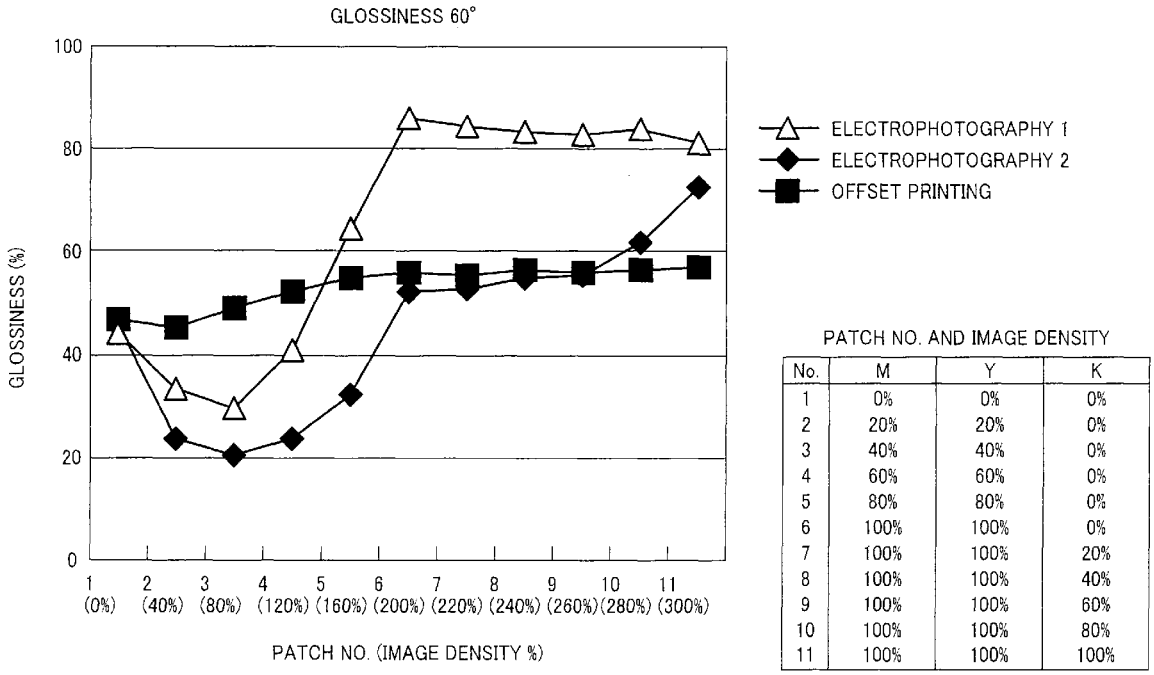
FIG. 13 is a graph showing an image density and glossiness of coated paper by electrophotography and offset printing.

Referring now to FIG. 12, there is provided a side view illustrating an image forming apparatus in which charging, exposure (optical writing), and development of toners of different colors are carried out using a single photoreceptor.

Generally, there is known a tandem-type image forming apparatus using four photoreceptors each designated for different colors. In such an image forming apparatus, an image forming operation is performed for each color on different photoreceptors.

By contrast, when the image forming operations for multiple colors are performed on the single photoreceptor, downsizing and cost reduction of the image forming apparatus as a whole can be achieved, compared with the tandem-type image forming apparatus.

Examples of a toner binder resin for use in the toner used in the image forming apparatus according to the illustrative embodiment include, but are not limited to styrene polymers and substituted styrene polymers such as polyester, polystyrene, poly-p-chlorostyrene and polyvinyltoluene; and styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers.

Furthermore, the following resins can be used by mixture. Examples include polymethylmethacrylate, polybutylmethacrylate, polyvinyl chloride, polyvinyl acetate, polyethylene, polypropylene, polyurethanes, polyamides, epoxy resins, polyvinylbutylal, polyacrylic resins, rosin, modified rosin, terpene resins, phenol resin, aliphatic or alicyclic hydrocarbon resins, aromatic petroleum resins, chlorinated paraffin, paraffin wax, and the like.

Among these, polyester resin is particularly preferred in order to achieve adequate fixability. A crystalline polyester resin, in particular, is adequately softened and fused when contacting a recording medium, thereby allowing reliable fixation and high color reproduction so that high imaging quality can be achieved.

The polyester resin is obtained by condensation polymerization of alcohol and carboxylic acid. Examples of alcohols include diols such as polyethylene glycol, diethylene glycol, triethylene glycol, 1,2-propylene glycol, 1,3-propylene glycol, 1,4-butanediol, neopentyl glycol and 1,4-butenediol, 1,4-bis (hydroxymethyl) cyclohexane, bisphenol A, hydrogen-added bisphenol A, etherificated bisphenols such as polyoxyethylene bisphenol A and polyoxypropylene bisphenol A, bivalent alcohols obtained by substituting the above compounds with a saturated or unsaturated hydrocarbon groups having 3 to 22 carbon atoms and other bivalent alcohols.

Furthermore, examples of carboxylic acids used for obtaining polyester resins include maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, bivalent organic acid monomers obtained by substituting the above-mentioned alcohol with a saturated or unsaturated hydrocarbon group having 3 to 22 carbon atoms, acid anhydride thereof, dimer of lower alkylester and linolenic acid and other bivalent organic acid monomers.

In order to obtain the polyester resin used as a binder resin, not only polymers composed of the above-mentioned difunctional monomers, but also polymers containing components of polyfunctional monomers having three or more functionalities are suitably used. Examples of a polyhydric alcohol monomer three or more functionalities, which is such polyfunctional monomer, include sorbitol, 1,2,3,6-hexanetetrol, 1,4-sorbitan, pentaerythritol, di-pentaerythritol, tripentaerythritol, sucrose, 1,2,4-butanetriol, 1,2,5-pentanetriol, glycerol, 2-methylpropanetriol, 2-methyl-1,2,4-butanetriol, trimethylol ethane, trimethylol propane, 1,3,5-trihydroxymethyl benzene, and the like Examples of tricarboxylic or more polycarboxylic acid monomer include 1,2,4-benzenetricarboxylic acid, 1,2,5-benzene tricarboxylic acid, 1,2,4-cyclohexanetricarboxylic acid, 2,5,7-naphthalenetricarboxylic acid, 1,2,4-naphthalenetricaboxylic acid, 1,2,4-butanetricaboxylic acid, 1,2,5-haxanetricaboxylic acid, 1,3-dicarboxyl-2-methyl-2-methylenecarboxylic-propane, tetra (methylenecalboxylic) methane, 1,2,7,8-octane tetracarboxylic acid, empol trimer acid, and acid anhydride thereof, and the like.

Furthermore, the toner used in the illustrative embodiments may comprise a releasing agent in order to improve release properties of the toner on the surface of the transfer-fixing member at the time of fixation of toner.

As a releasing agent, any known releasing agents can be used, and particularly, a free fatty acid-removed carnauba wax, montan wax, oxidized rice wax, and ester wax can be used alone or in combination. As the carnauba wax, ones in the form of microcrystal are suitable, and among these, ones having an acid value of 5 or less and having particle diameter of 1 μm or less when dispersed in a toner binder are preferable. The montan wax generally refers to montan-based wax refined from minerals.

Similar to the carnauba wax, the montan wax is preferably microcrystal and has an acid value of 5 to 14. The oxidized rice wax is rice bran wax oxidized with air, the acid value thereof is preferably 10 to 30. In the case where the acid value of each wax is less than the respective range, low-temperature fixing temperature increases, resulting in poor low-temperature fixation. Conversely, in the case where the acid value exceeds each range, cold offset temperature increases, resulting in poor low-temperature fixation.

The additive amount of the wax is 1 parts by weight to 15 parts by weight, preferably 3 parts by weight to 10 parts by weight, relative to 100 parts by weight of binder resin. According to the illustrative embodiment, the additive amount of the wax of 1 parts by weight to 3 parts by weight is enough to realize the present invention. When it exceeds 15 parts by weight, problems may occur such as a consumption of the toner to carrier becoming excessive.

Further, in order to improve fluidity of the toner, hydrophobic silica, titanium oxide, alumina, or the like may be added as an external additive, and fatty acid metal salts, polyvinylidene fluoride, or the like may further be added as necessary.

According to the illustrative embodiment, the present invention is employed in the electrophotographic image forming apparatus. However, the heating device for heating the recording medium according to the illustrative embodiment is not limited to the electrophotographic image forming apparatus, but can be applied to an ink-jet image forming apparatus.

Such an ink-jet image forming apparatus includes an inkjet recording device, the heating guide member, and pressure member provided facing the heating guide member. The heating guide member is a plate member or an endless belt. When the heating guide member is a plate member, the plate member consists of a plurality of sub-platess arranged in a width direction perpendicular to the direction of transport of the recording medium. When the heating guide member is the endless belt, the belt is wound around and stretched by a plurality rollers including a heat source. The contact condition between the pressure member and the recording medium is either point contact or line contact.

With this configuration, the recording medium can be efficiently heated with less energy, and moisture in the recording medium is released, thereby preventing problems such as smudges of ink upon inkjet printing and cockling of the recording medium.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image bearing member to bear an electrostatic latent image on a surface thereof;

a developing device to develop the electrostatic latent image formed on the image bearing member into a toner image using a toner;

a transfer-fixing member disposed adjacent to the image bearing member, the transfer fixing member including a transfer surface onto which the toner image is transferred from the image bearing member;

a first pressure member to meet and press against the transfer-fixing member to form a nip therebetween;

a heating member to heat a recording medium, provided upstream of the nip in a direction of transport of the recording medium; and a transport guide member to change a contact area of the recording medium and the heating member in accordance with a thickness of the recording medium, the transport guide member blocking a passage for the recording medium being transported and pressing against a lower guide plate in a first position, wherein the transport guide member is disposed upstream of any contact between the recording medium and the recording medium heating member in the direction of transport of the recording medium, wherein when the recording medium passes the nip, the toner image is pressed and fixed on the recording medium, wherein when a leading end of the recording medium contacts the transport guide member, the transport guide member separates from the lower guide plate in a second position and guides the leading end of the recording medium towards the heating member, a distance between transport guide member and the lower guide plate in the second position being based on the thickness of the recording medium, and wherein the transport guide member increases the contact area of the recording medium and the recording medium heating member in response to an increase in the thickness of the recording medium.

2. The image forming apparatus according to claim 1, wherein the transport guide member is rotatable about a support point and changes the contact area of the recording medium and the heating member by changing an angle of rotation of the transport guide member in accordance with the thickness of the recording medium.

3. The image forming apparatus according to claim 1, wherein the transport guide member rotates when the leading end of the recording medium transported contacts the transport guide member, and a length and the center of the rotation of the transport guide member are configured to allow the contact area of the recording medium and the heating member to change in accordance with the thickness of the recording medium.

4. The image forming apparatus according to claim 1, wherein the heating member is a plate member.

5. The image forming apparatus according to claim 4, wherein the plate member comprises a plurality of sub-plates arranged in a width direction perpendicular to the direction of transport of the recording medium.

6. The image forming apparatus according to claim 5, wherein an oblique gap relative to the direction of transport of the recording medium is provided between each sub-plate of the plurality of sub-plates.

7. The image forming apparatus according to claim 5, wherein the plurality of sub-plates is integrally held by a stay member through a support member, a heat transfer coefficient of the support member is lower than the stay member, and the contact area of the support member is small.

8. The image forming apparatus according to claim 1, wherein the heating member is an endless belt wound around and stretched between a plurality of rollers, the plurality of rollers including a heat source.

9. The image forming apparatus according to claim 1, further comprising a second pressure member provided opposite the heating member, wherein a contact condition between the second pressure member and the recording medium is one of point contact and line contact.

10. The image forming apparatus according to claim 1, wherein the image forming apparatus uses an electrophotographic image forming method.

11. The image forming apparatus according to claim 1, further comprising a preheater to preheat the image transferred onto the transfer-fixing member.

12. An image forming apparatus, comprising:

an image bearing member configured to bear an electrostatic latent image on a surface thereof;

a developing device configured to develop the electrostatic latent image formed on the image bearing member into a toner image using a toner;

a transfer-fixing member disposed adjacent to the image bearing member, the transfer-fixing member including a transfer surface onto which the toner image is transferred from the image bearing member;

a first pressure member to meet and press against the transfer-fixing member to form a nip therebetween;

a heating member to heat a recording medium, provided upstream of the nip in a direction of transport of the recording medium; and a transport guide member to change a contact area of the recording medium and the heating member in accordance with a resilience of the recording medium, the transport guide member blocking a passage for the recording medium being transported and pressing against a lower guide plate in a first position, wherein the transport guide member is disposed upstream of any contact between the recording medium and the recording medium heating member in the direction of transport of the recording medium, wherein when the recording medium passes the nip, the toner image is pressed and fixed on the recording medium, wherein when a leading end of the recording medium contacts the transport guide member, the transport guide member separates from the lower guide plate in a second position and guides the leading end of the recording medium towards the heating member, a distance between transport guide member and the lower guide plate in the second position being based on the resilience of the recording medium, and wherein the transport guide member increases the contact area of the recording medium and the recording medium heating member in response to an increase in the resilience of the recording medium.

13. The image forming apparatus according to claim 12, wherein the transport guide member is rotatable about a support point and changes the contact area of the recording medium and the heating member by changing an angle of rotation of the transport guide member in accordance with the resilience of the recording medium.

14. The image forming apparatus according to claim 12, wherein the transport guide member rotates when the leading end of the recording medium transported contacts the transport guide member, and the transport guide member is configured to allow the contact area of the recording medium and the heating member to change in accordance with the resilience of the recording medium.

15. The image forming apparatus according to claim 12, wherein the heating member is a plate member.

16. The image forming apparatus according to claim 15, wherein the plate member comprises a plurality of sub-plates disposed in a width direction perpendicular to the direction of transport of the recording medium.

17. The image forming apparatus according to claim 16, wherein an oblique gap relative to the direction of transport of the recording medium is provided between each sub-plate of the plurality of sub-plates.

18. The image forming apparatus according to claim 16, wherein the plurality of plate members is integrally held by a stay member through a support member, a heat transfer coefficient of the support member is lower than the stay member, and the contact area of the support member is small.

19. The image forming apparatus according to claim 12, wherein the heating member is an endless belt wound around and stretched between a plurality of rollers, the plurality of rollers including a heat source.

20. The image forming apparatus according to claim 12, further comprising a second pressure member provided opposite the heating member, wherein a contact condition between the second pressure member and the recording medium is one of point contact and line contact.

* * * * *